United States Patent [19]

Patton et al.

[11] Patent Number: 5,074,004

[45] Date of Patent: Dec. 24, 1991

[54] SWIMMING POOL TILE CLEANING APPARATUS

[76] Inventors: Everil E. Patton, RR #2 Truro; Mark E. Patton, 1027 Prince St., both of Truro, Nova Scotia, Canada

[21] Appl. No.: 541,372

[22] Filed: Jun. 21, 1990

[51] Int. Cl.[5] ..... A46B 13/04; A47L 11/18

[52] U.S. Cl. ..... 15/50.3; 15/1.7; 15/52.1; 15/143 A

[58] Field of Search ..... 15/49.1, 50.3, 52.1, 15/1.7, 23, 24, 98, 160

[56] References Cited

U.S. PATENT DOCUMENTS

| | | | |
|---|---|---|---|
| 1,485,680 | 3/1924 | Hughes | 15/52.1 |
| 1,794,460 | 3/1931 | Isenman | 15/52.1 |
| 3,295,540 | 1/1967 | Ortega | 15/1.7 |
| 3,654,656 | 4/1972 | Romagosa | 15/50.3 |
| 4,302,122 | 11/1981 | Moya | 15/50.3 |
| 4,324,015 | 4/1982 | Head | 15/1.7 |
| 4,399,578 | 8/1983 | Bordeaux | 15/24 |
| 4,733,427 | 3/1988 | Conrad | 15/160 |
| 4,875,246 | 10/1989 | MacGregor | 15/50.3 |

FOREIGN PATENT DOCUMENTS

| | | | |
|---|---|---|---|
| 1229704 | 12/1966 | Fed. Rep. of Germany | 15/49.1 |
| 2023593 | 11/1971 | Fed. Rep. of Germany | 15/1.7 |
| 8600245 | 1/1986 | PCT Int'l Appl. . | |

*Primary Examiner*—Harvey C. Hornsby
*Assistant Examiner*—R. Chin
*Attorney, Agent, or Firm*—Leon Gilden

[57] ABSTRACT

An apparatus including a buoyant housing including a rotatable brush directed longitudinally through a forward opening of the housing, wherein the housing includes a sealed battery and motor for selective actuation of the brush. An angulated handle is directed forwardly and spaced above the housing and arranged at a relative acute angle to a top surface of the housing to permit an individual to direct the brush about a forward surface of a swimming pool apron. A modification of the instant invention includes a plurality of spaced buoyancy members mounted adjacent sides of the housing to permit adjustment of the housing relative to an associated water level within a swimming pool.

3 Claims, 5 Drawing Sheets

SWIMMING POOL TILE CLEANING APPARATUS

BACKGROUND OF THE INVENTION

1. Field of the Invention

The field of invention relates to swimming pool cleaning apparatus, and more particularly pertains to a new and improved swimming pool tile cleaning apparatus wherein the same permits floatation of the apparatus about an upper surface of the swimming pool to permit direct access and cleaning of tiles aligned with the upper surface of the swimming pool to permit cleaning of those tiles.

2. Description of the Prior Art

The prior art has utilized brushes and the like to permit cleaning of swimming pool tiles of an associated swimming pool structure. Tiles that require extensive cleaning are generally associated with a surface level of a swimming pool. The instant invention attempts to overcome deficiencies of the prior art by permitting the brush cleaning housing to float medially of the swimming pool surface to provide direct access to those tiles needing cleaning. Examples of the prior art include U.S. Pat. No. 4,578,837 to Baer illustrating the use of a rotating brush mounted to a framework incorporating a drive motor for the brush, wherein the framework includes wheels for rotatably directing the brush against tile surfaces of an associated swimming pool.

U.S. Pat. No. 3,755,845 to Coult provides a frictionally driven rotating cleaning apparatus wherein manual directing of the apparatus imparts rotation to an associated brush within the apparatus.

U.S. Pat. No. 3,196,473 to Bell utilizes a hand-held grill cleaner wherein a brush is rotatably mounted to a lowermost forward end of the apparatus.

U.S. Pat. No. 4,324,015 to Head sets forth a repositionable swimming pool tile cleaner wherein the apparatus includes a housing mounted upon a castor for repositioning of the apparatus about a swimming pool apron, with a downwardly directed rotatable brush for cleaning of the tile associated with the swimming pool.

U.S. Pat. No. 4,780,992 to McKervey provides an apparatus for swimming pool tile cleaning wherein a hand-held organization of a generally "L" shaped configuration includes a downwardly directed rotatable brush for cleaning of tile adjacent a swimming pool apron, with an injector organization to direct a cleaning fluid to the surface of the rotating brush.

As such, it may be appreciated that there continues to be a need for a new and improved swimming pool tile cleaning apparatus wherein the same addresses both the problems of ease of use, as well as effectiveness in the positioning and directing of the swimming pool brush about a tile surface of a swimming pool organization.

SUMMARY OF THE INVENTION

In view of the foregoing disadvantages inherent in the known types of swimming pool tile cleaning apparatus now present in the prior art, the present invention provides a swimming pool tile cleaning apparatus wherein the same provides a buoyancy housing to permit floatingly directing a brush adjacent a swimming pool water surface to effect cleaning of tile disposed thereabout. As such, the general purpose of the present invention, which will be described subsequently in greater detail, is to provide a new and improved swimming pool tile cleaning apparatus which has all the advantages of the prior art tile cleaning apparatus and none of the disadvantages.

To attain this, the present invention provides an apparatus including a buoyant housing including a rotatable brush directed longitudinally through a forward opening of the housing, wherein the housing includes a sealed battery and motor for selective actuation of the brush. An angulated handle is directed forwardly and spaced above the housing and arranged at a relative acute angle to a top surface of the housing to permit an individual to direct the brush about a forward surface of a swimming pool apron. A modification of the instant invention includes a plurality of spaced buoyancy members mounted adjacent sides of the housing to permit adjustment of the housing relative to an associated water level within a swimming pool.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved swimming pool tile cleaning apparatus which has all the advantages of the prior art swimming pool tile cleaning apparatus and none of the disadvantages.

It is another object of the present invention to provide a new and improved swimming pool tile cleaning apparatus which may be easily and efficiently manufactured and marketed.

It is a further object of the present invention to provide a new and improved swimming pool tile cleaning apparatus which is of a durable and reliable construction.

An even further object of the present invention is to provide a new and improved swimming pool tile cleaning apparatus which is susceptible of a low cost of manufacture with regard to both materials and labor, and which accordingly is then susceptible of low prices of sale to the consuming public, thereby making such swimming pool tile cleaning apparatus economically available to the buying public.

Still yet another object of the present invention is to provide a new and improved swimming pool tile cleaning apparatus which provides in the apparatuses and methods of the prior art some of the advantages thereof, while simultaneously overcoming some of the disadvantages normally associated therewith.

Still another object of the present invention is to provide a new and improved swimming pool tile cleaning apparatus wherein the same permits floatingly directing a brush about a swimming pool water surface to effect cleaning of tile disposed adjacent a swimming pool water level permitting effective cleaning of such tile.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
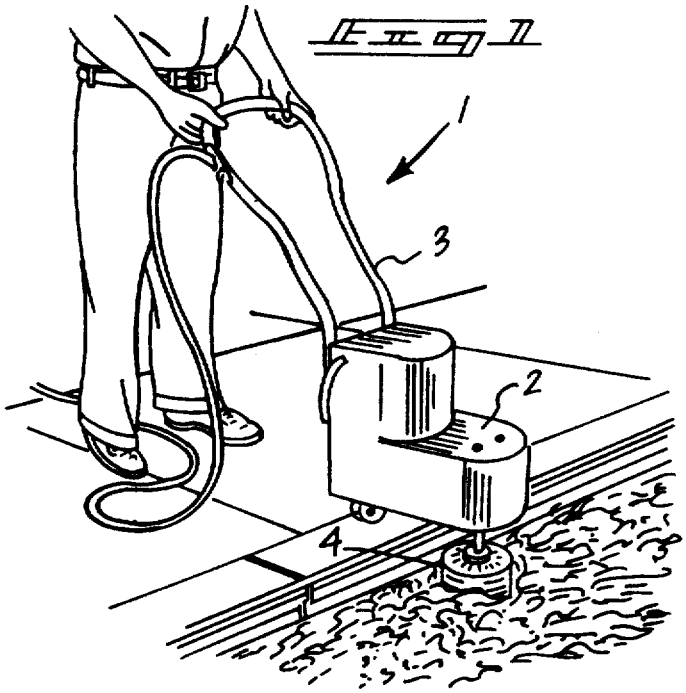
FIG 1 PRIOR ART
FIG. 1 is an isometric illustration of a prior art swimming pool tile cleaning apparatus.

With reference now to the drawings, and in particular to FIGS. 1 to 9 thereof, a new and improved swimming pool tile cleaning apparatus embodying the principles and concepts of the present invention and generally designated by the reference numerals 10, 10*a*, and 10*b* will be described.

FIG. 1 illustrates a prior art tile cleaning organization 1, including a housing 2 formed with a rearwardly extending handle 3 and a downwardly extending brush 4 positioned at opposed ends of the housing, with a castor member secured to a bottom surface of the housing to permit rolling of the housing along a swimming pool apron to permit cleaning of tile disposed adjacent the apron.

Figure 2:
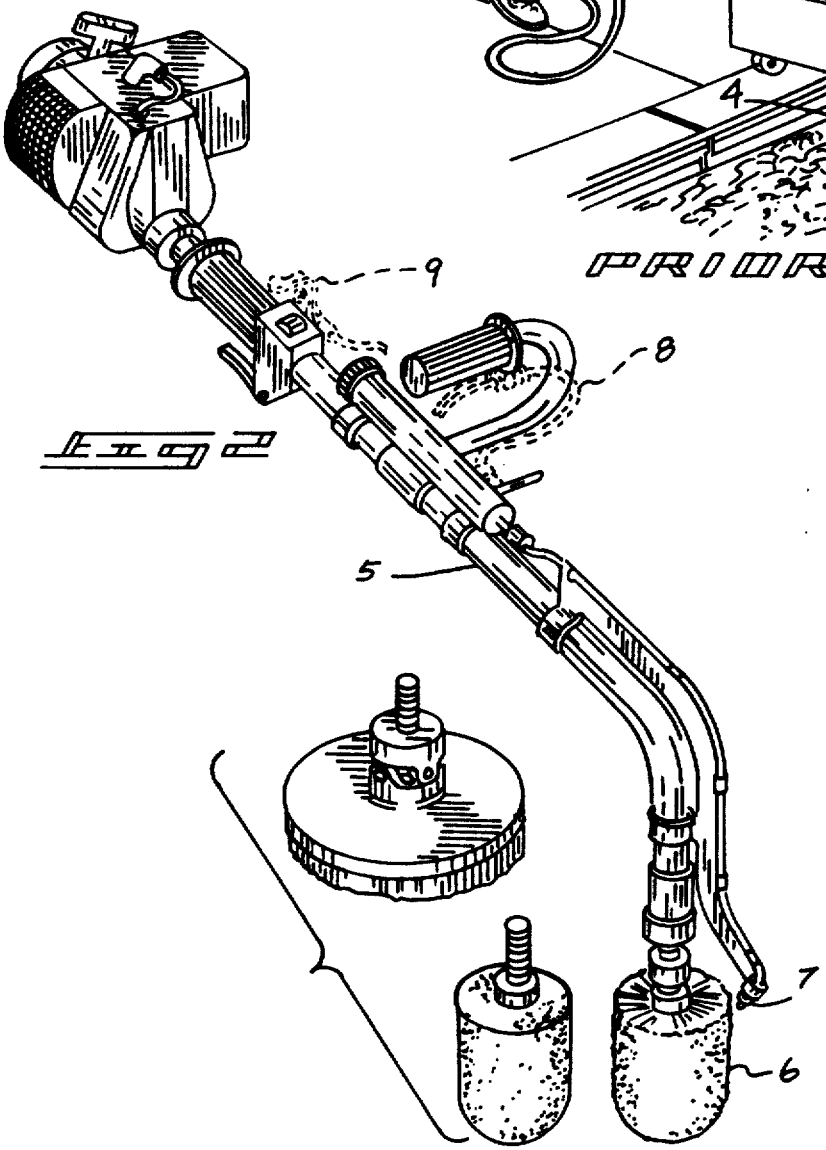
FIG 2 PRIOR ART
FIG. 2 is an isometric illustration of a further prior art tile cleaning apparatus.
Figure 3:
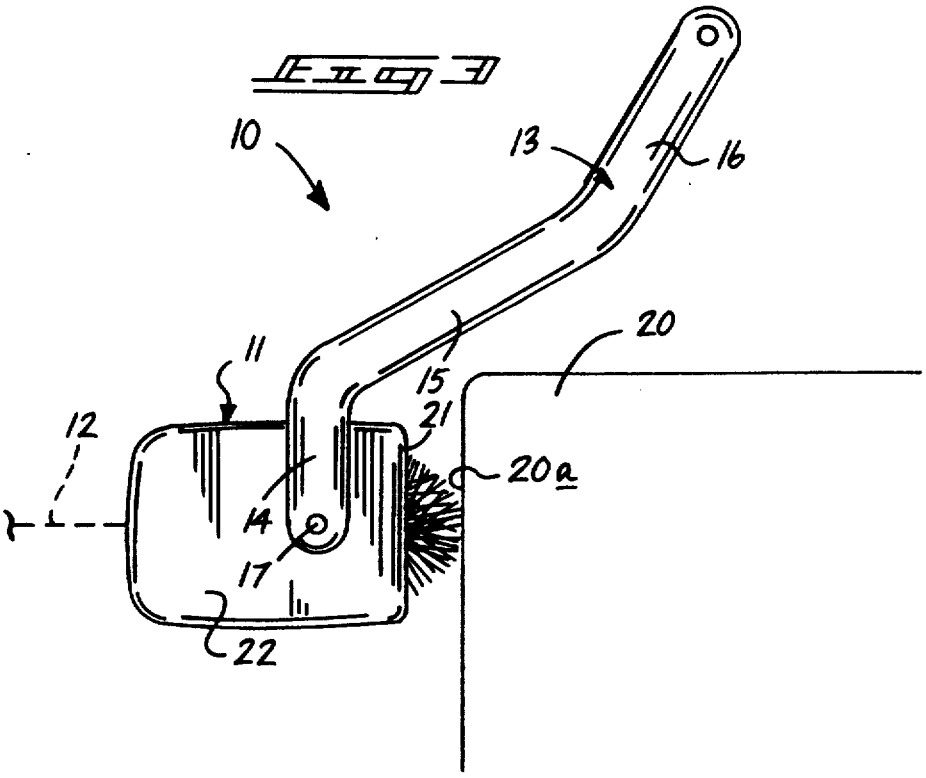
FIG. 3 is an orthographic side view taken in elevation of the instant invention.
Figure 4:
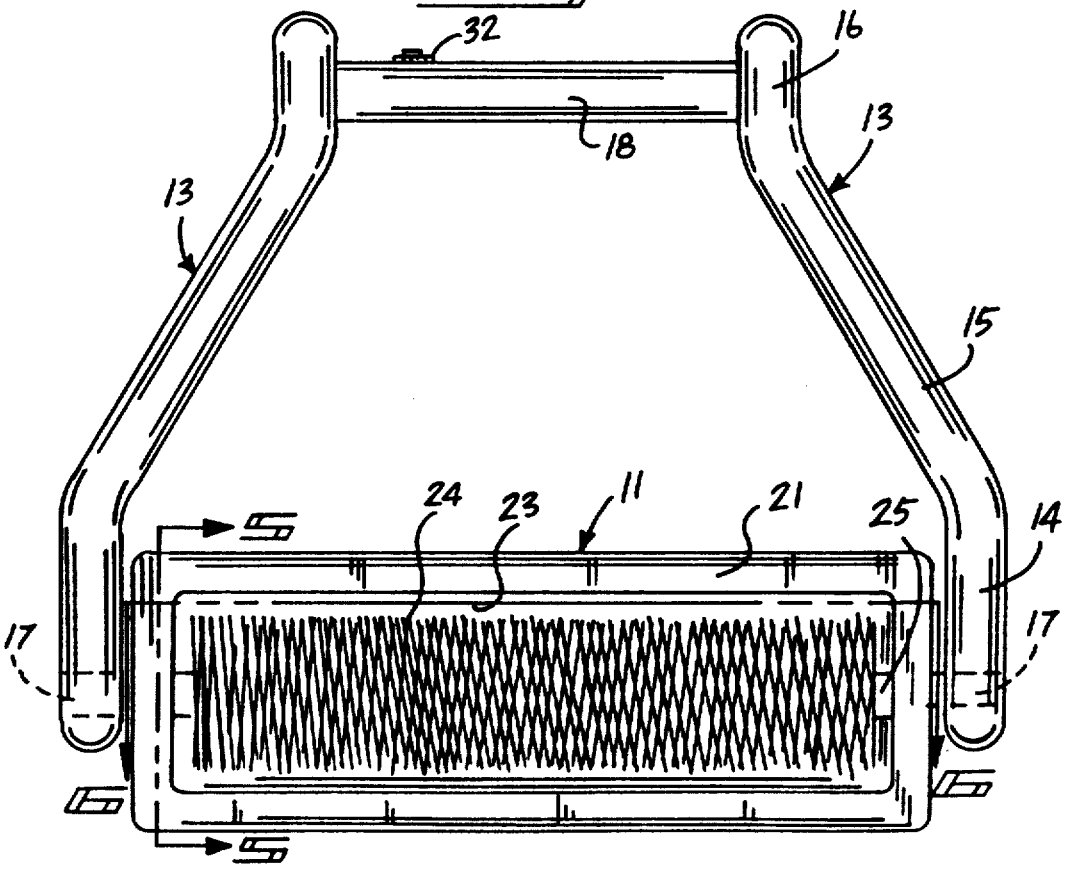
FIG. 4 is an orthographic frontal view taken in elevation of the instant invention.
Figure 5:
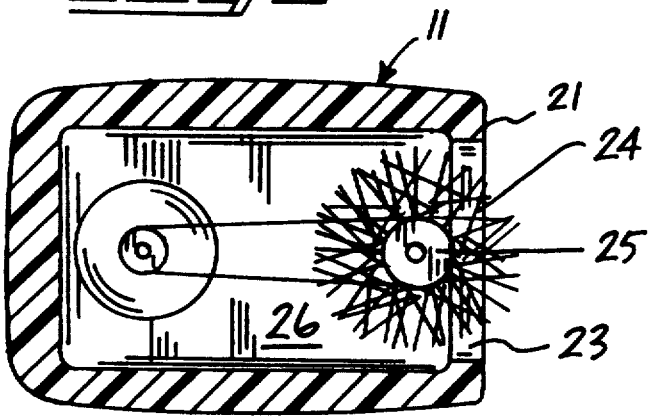
FIG. 5 is an orthographic cross-sectional view of the housing of the instant invention.
Figure 6:
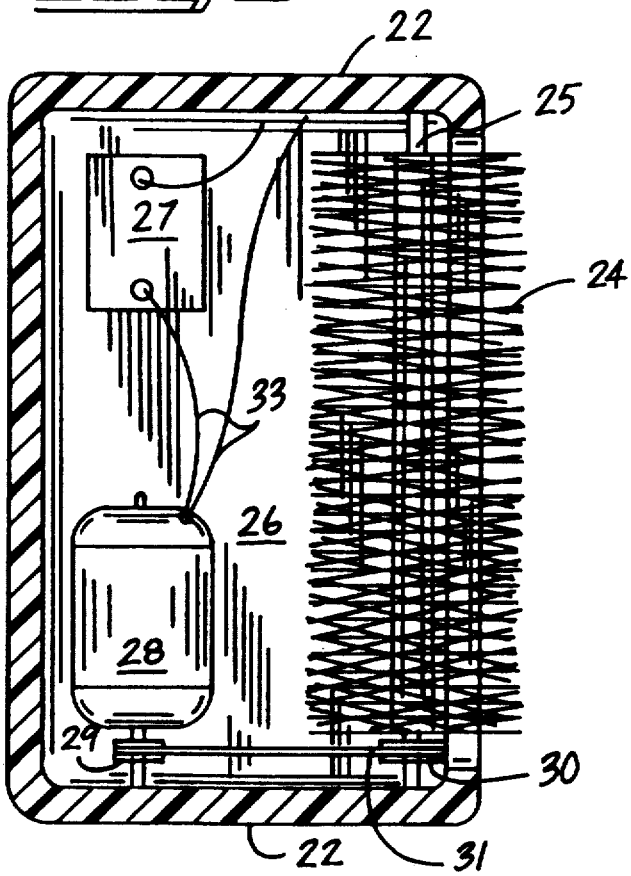
FIG. 6 is an orthographic cross-sectional top view of the housing of the instant invention.

FIG. 2 illustrates a further prior art tile cleaning apparatus wherein an elongate, generally "L" shaped tubular member 5 includes a drive shaft to rotate a brush 6 at a forward lowermost end of the housing, with a fluid cleaner injector 7 operative through a first handle 8 or a second handle 9 to direct cleaning fluid to the brush member.

More specifically, the swimming pool tile cleaning apparatus 10 of the instant invention essentially comprises a buoyant polymeric housing 11 defined by a specific gravity to permit the housing 11 to float on the swimming pool water level surface 12. The housing includes spaced handle leg members 13 fixedly mounted to spaced side walls 22 of the housing. The handle members 13 are generally arranged parallel relative to one another, with a grasp handle 18 integrally and orthogonally joining the spaced handles 13 together. The handle leg members 13 each include a lowermost first leg 14 arranged parallel to a forward wall 21 of the housing 11, with a second leg 15 arranged at an obtuse included angle between the first leg and second leg, with a third leg 16 arranged at an obtuse included angle between the second leg and third leg to orient the third leg 16 at an include angle defined between the third leg 16 and a horizontal axis of the housing 11 defined by forty-five degrees. Each of the first legs 14 are secured to the side walls 22 of the housing by pivot support axles 17 to fixedly mount the handles to the side walls. In this manner, an individual positioned upon the swimming pool apron 20 is positioned to direct a forwardly mounted rotatable cylindrical brush 24 against vertical tile 20*a* of the swimming pool organization.

The forward wall 21 of the housing 11 includes an elongate, rectangular opening 23, with the rotatable cylindrical brush 24 disposed to extend beyond the forward wall 21 from interiorly of the housing cavity 26 defined interiorly of the housing 11. The brush 24 is rotatably mounted upon a brush support axle 25 aligned substantially parallel in a spaced relationship relative to the handle support axles 17. The housing cavity 26 includes an underwater rechargeable battery pack 27 and a fluid sealed electric motor 28 that mounts a first motor pulley 29 upon its output shaft and is aligned with a second motor pulley 30 mounted to the brush support axle 25, with a continuous drive belt 31 mounted between the first and second motor pulleys 29 and 30 to effect selective rotation of the brush 24 through a switch 32 mounted upon the grasp handle 18. Electrical transmission wires 33 electrically communicate the switch 32 with the motor 28 and battery pack 27.

Figure 7:
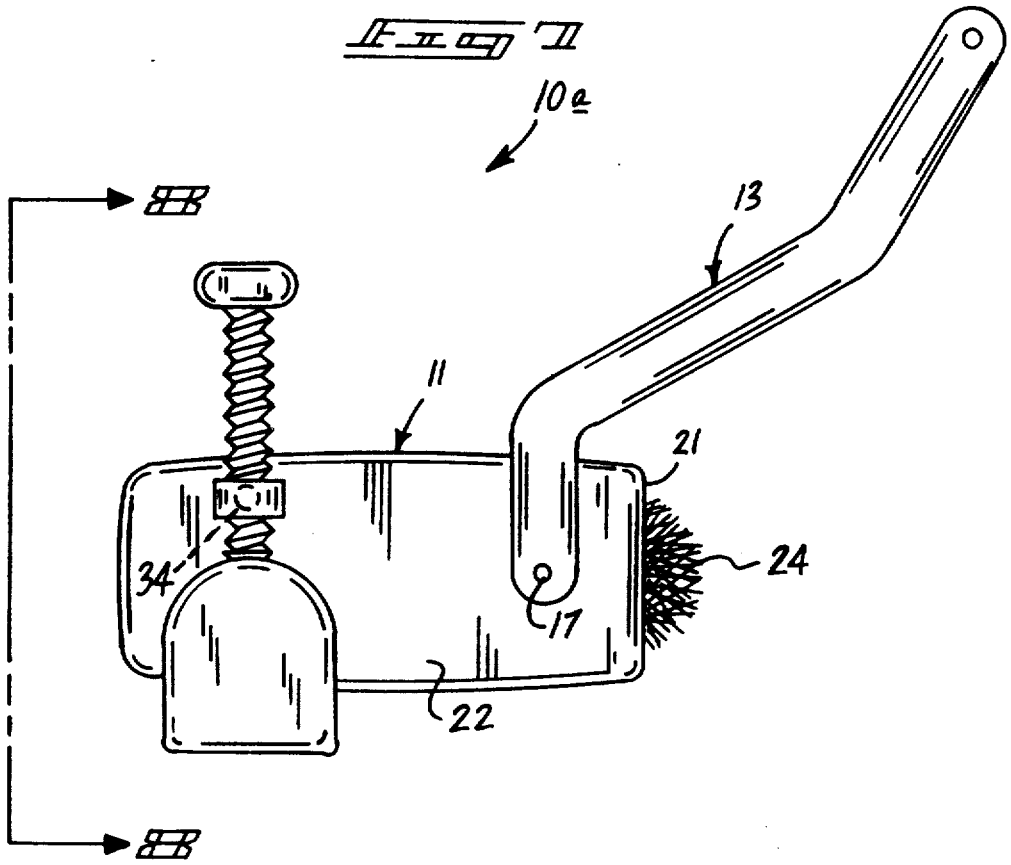
FIG. 7 is an orthographic side view taken in elevation of a modification of the instant invention.
Figure 8:
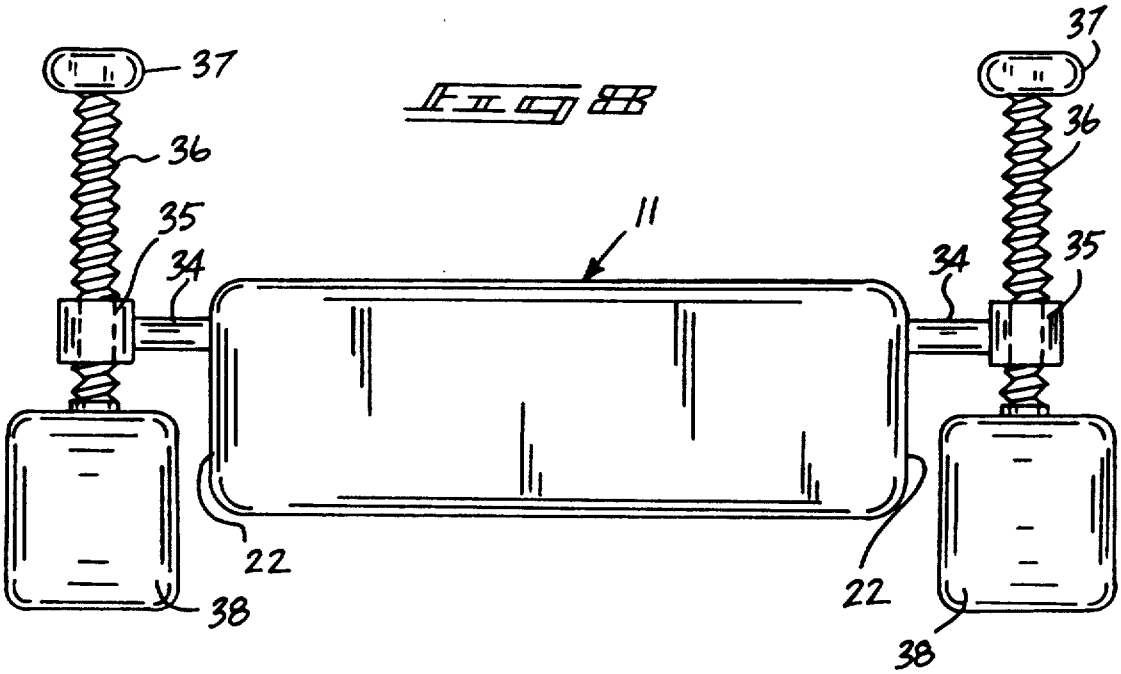
FIG. 8 is an orthographic view taken along the lines 8—8 of FIG. 7 in the direction indicated by the arrows.

Reference to FIG. 7 illustrates a modified apparatus 10*a*, wherein the housing 11 includes a pair of aligned support arms 34 arranged generally parallel to the handle support axle 17 and spaced therefrom. Each of the support arms 34 includes an internally threaded boss member 35, with the threaded bore of each boss 35 arranged in a vertical orientation generally parallel to the first legs 14 of the handle leg members 13. An elongate threaded shaft 36 is threadedly receivable within each threaded bore of each threaded boss member 35 to permit vertical adjustment of each threaded shaft 36 with a shaft handle 37 mounted to each upper terminal end of each threaded shaft 36. A sealed pneumatic chamber 38 is integrally mounted to each lowermost terminal end of each threaded shaft. The pneumatic chamber 38 permits height adjustment of the housing 11 and associated brush 24 to permit adjustment of the brush 24 in its relationship to swimming pool tile 28 to be cleaned.

Figure 9:
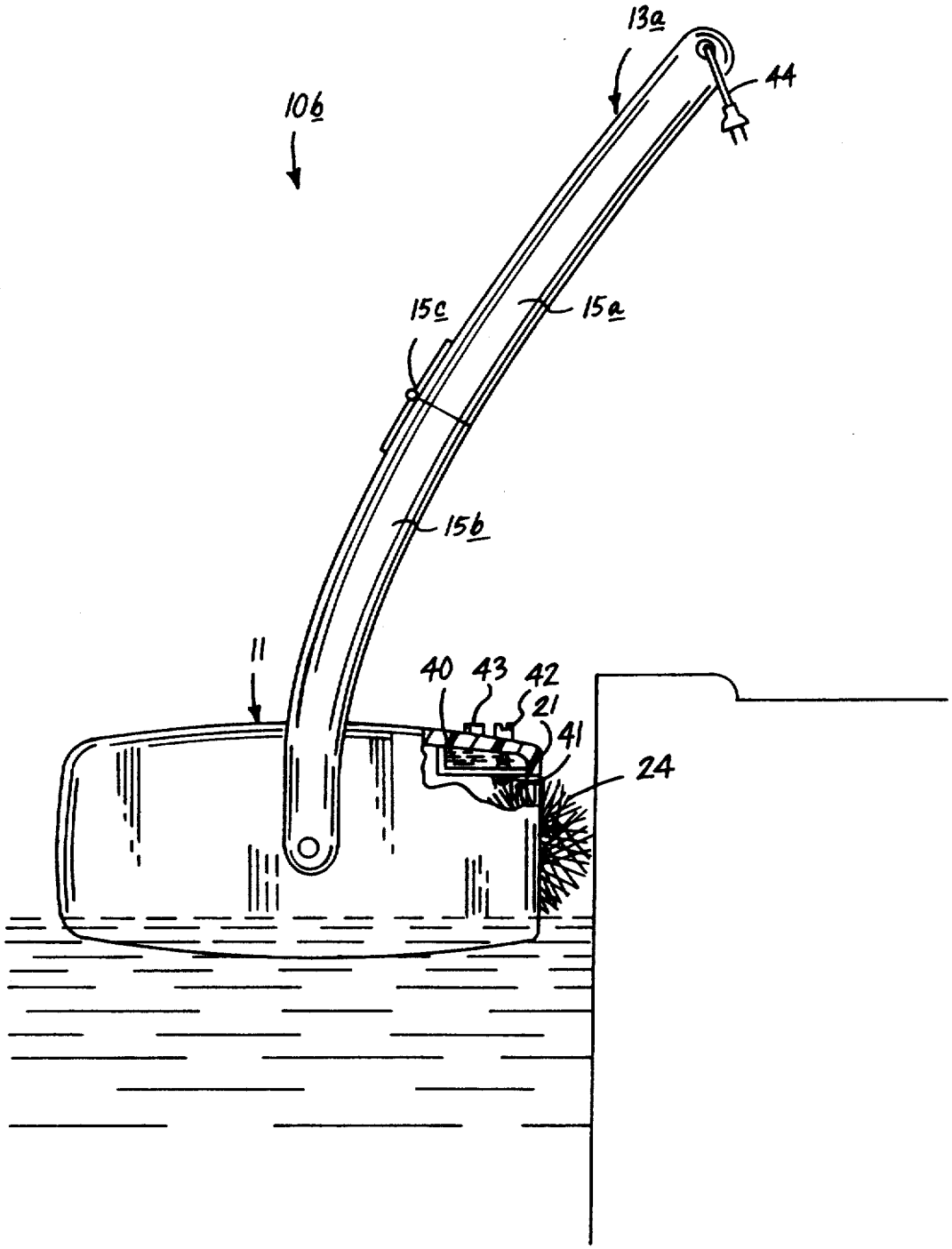
FIG. 9 is illustrative of a modified pool tile cleaning apparatus.

FIG. 9 is illustrative of a modified pool tile cleaning apparatus 10b, wherein a modified handle 13a includes an upper leg 15a pivotally mounted to a lower leg 15b about a medially oriented hinge 15c to permit over-folding of the handle 13a during storage and transport of the organization. A plurality of such handles are utilized in a manner as set forth in FIG. 4 for example. Further, the housing 11 includes a soap dispensing reservoir 40 accessible through a removable plug 43 to direct a soap solution in a metered manner overlying the brush 24. An orifice 41 is in communication with the reservoir 40 and is adjustable through a screw 42 threadedly mounted through the housing 11 and positionable within the venturi 41 to adjust metering of the soap solution within the reservoir 40. Further, an electrical cord 44 in electrical communication with the rechargeable battery pack 27 permits selective recharging of the battery pack 27 prior art, during, or subsequent to use of the organization to ensure adequate electrical energy supply of the rechargeable battery pack for use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art. and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A swimming pool tile cleaning apparatus arranged for floatation on a body of water to effect cleaning of a surrounding wall surface wherein the apparatus comprises, a housing member including spaced parallel sides and forward wall orthogonally directed between the parallel sides, the housing member including a cavity therewithin, and an elongate, cylindrical brush rotatably mounted within the cavity, and wherein the forward wall includes a rectangular opening therethrough, and the cylindrical brush projects through the rectangular opening, and the cylindrical brush rotatably mounted about a brush axle, the brush axle spaced from and parallel to the forward wall, and an elongate handle directed upwardly from the housing, the handle including spaced first and second leg members, each leg member mounted to an opposed side wall, and each leg member including an upper leg portion spaced forwardly and upwardly of the forward wall, and wherein the housing member is buoyant relative to water when positioned in the body of water, and wherein each leg member includes a first leg orthogonally mounted relative to a top wall of the housing member, and wherein each first leg of each leg member includes a leg axle orthogonally oriented relative to each side wall to mount each respective first leg member to each respective side wall, and each first leg member including a second leg integrally mounted to each upper end of each first leg, and second leg oriented at an obtuse angle integrally mounted to each second leg including an obtuse included angle between each respective upper leg and each second leg, and an elongate grasp handle orthogonally and integrally mounted between each respective upper leg portion, and wherein the housing defines a cavity and includes a fluid impermeable water pack electrically associated with a fluid sealed electric motor, the electric motor operatively mounted to the cylindrical brush support axle including a first pulley mounted to the motor and a second pulley mounted to the support axle, and a continuous belt mounted between the first and second pulley, and a switch mounted on the handle to selectively actuate the electric motor, and further including a first and second buoyancy member mounted to each respective side wall, each buoyancy member including a support arm orthogonally mounted to each respective wall, and an internally threaded boss member integrally mounted to a remote terminal end of each support arm, and a threaded shaft adjustably and threadedly mounted through each boss member, each threaded shaft aligned substantially parallel to the forward wall, and a sealed pneumatic chamber mounted to each lower terminal end of each threaded shaft.

2. An apparatus as set forth in claim 1 wherein the first and second leg members of the handle each include a hinge positioned medially of the first and second leg members to prevent over-folding of the first and second leg members for storage and transport of the organization.

3. An apparatus as set forth in claim 2 further including a fluid soap reservoir mounted within the housing adjacent the forward wall, wherein the reservoir includes a removable plug for permitting refilling of the reservoir, and the reservoir includes a venturi valve overlying the brush, wherein the venturi valve includes a threaded adjustment member vertically adjustable relative to the venturi member to permit metered adjustment of an aqueous solution of soap directed to the brush.

* * * * *